United States Patent [19]

Richardson et al.

[11] Patent Number: 4,928,891

[45] Date of Patent: May 29, 1990

[54] CRUSHING APPARATUS HAVING A FLUID SUPPLY MEANS ASSOCIATED WITH A ROTARY CRUSHER

[76] Inventors: Larie Richardson, 8835 Barrette Ave., Rosemead, Calif. 91770; Harold Steingold, 407 16th St., Santa Monica, Calif. 90402

[21] Appl. No.: 289,038

[22] Filed: Dec. 23, 1988

[51] Int. Cl.[5] ..... B02C 4/00

[52] U.S. Cl. ..... 247/41; 241/57; 241/62; 241/207

[58] Field of Search ..... 241/38, 41, 57, 62, 241/207–216

[56] References Cited

U.S. PATENT DOCUMENTS

| | | | |
|---|---|---|---|
| 2,138,715 | 11/1938 | Thorsen | 241/38 X |
| 2,753,121 | 7/1956 | Elfenbeir | 241/38 X |
| 3,249,310 | 5/1966 | Willems | 241/38 X |
| 3,284,010 | 11/1966 | Bodine, Jr. | 241/38 |
| 3,596,841 | 8/1971 | Perry | 241/38 |
| 4,750,679 | 6/1988 | Karra et al. | 241/41 |

*Primary Examiner*—Timothy V. Eley

[57] ABSTRACT

An apparatus for injecting fluid into the crushing region of a rotary crusher, which may be either a gyratory crusher or a cone crusher, is disclosed. The injection of fluid can be through conventional nozzles, ports, or through other shapes of apertures. The injection of fluid can be on a continuous basis, on a time-modulated basis, or on a spatially modulated basis. The invention is not limited to use with a particular type of material to be crushed, nor is it limited to use with a particular type of injected fluid. Performance is improved in three areas: (a) a substantial throughput increase is achieved, (b) the output produce is more uniform and therefore of higher value than a non-uniform product would be, and (c) greater size reduction is achieved on a single pass. The invention can increase the capacity of an existing crushing installation, or enable use of a smaller crusher than would normally be required. In either case, the invention will result in a substantial cost saving as compared to crushers operating without benefit of this invention.

2 Claims, 5 Drawing Sheets

CRUSHING APPARATUS HAVING A FLUID SUPPLY MEANS ASSOCIATED WITH A ROTARY CRUSHER

FIELD OF INVENTION

The present invention relates to equipment used to improve the performance of crushing machines, such as rock crushers, used for crushing large particles into smaller particles. In particular, said invention relates to a method of introducing a fluid into the crushing apparatus, thereby improving the performance of the crushing operation.

BACKGROUND OF THE TECHNOLOGY

Mechanical crushers operate by crushing, or breaking, large particles between two surfaces. Specific types of mechanical crushers include jaw crushers, roll crushers, gyratory crushers, and cone crushers. All crushers require a substantial input of power because so much work is required to crush rock or similar materials. All form of crushers also require some sort of feed mechanism, such as a conveyor belt and feed hoppers, to provide a continuous supply of raw material to the crusher.

Jaw crushers comprise a movable jaw and a stationary jaw. The movable jaw is driven toward the stationary jaw with great force. The jaws thus function like a gigantic pair of pliers - material to be crushed is squeezed between the movable jaw and the stationary jaw. A variety of force multiplying mechanisms are employed in different jaw crushers to convert the mechanical input energy, typically from an electric motor, into the large linear forces required by the movable jaw. Jaw crushers are relatively simple and powerful. Because a portion of their operating cycle is necessarily devoted to opening the jaws, they can only operate intermittently.

Roll crushers operate by squeezing the material between two rollers. Their operating principle is similar to that of a jaw crusher, but each jaw is replaced by a driven roller. Their primary advantage vis-a-vis jaw crushers is that, since they have no opening stroke, they can operate continuously. Both jaw and roller crushers are oriented with their crushing opening vertical, so that material to be crushed is fed into the crusher by gravity.

Gyratory or cone crushers are both classified as rotary crushers. Both gyratory and cone crushers operate by continuously rotating an inner conical member, the mantle, eccentrically relative to an outer stationary conical member, the liner. The main difference between the two is that, in a gyratory crusher, the space between the two members is essentially vertical, whereas in a cone crusher, the space between the two members is inclined more toward the horizontal. The distinction between the two is illustrated in FIGS. 1 and 2, showing a plan view and a cross section through a cone crusher, respectively, and FIG. 3, showing a cross section through a gyratory crusher. In both types of rotary crushers, gyratory and cone, the slope of the mantle and slope of the liner are different, so that the space between the mantle and liner decreases as material moves downward between them. Material to be crushed falls downward, under the influence of gravity, between the stationary and moving members. In the case of a cone crusher, centrifugal force may have a secondary effect in moving the material to be crushed. Large material falling through this space is wedged between the mantle and the liner, and the material is crushed as it falls downward. When it is reduced to a small enough size, it passes out of the crusher through the smallest gap between the jaws, which is the "closed side setting". Crushers usually receive an input of rock, or similar material, in a wide range of sizes. Material which is small enough should pass through the crusher without being further crushed. Material which is large enough to be acted upon by the crushing apparatus will be crushed small enough to exit via the output aperture. However, there are a number of reasons why crushing does not proceed as simply or smoothly as this basic description would suggest.

The major technical characteristics desired of a crusher are:

High throughput, uniform output product, having a specific size distribution, and large size reduction on a single pass.

Each of these technical characteristics result in a better product and/or a lower cost of producing the product. Each technical characteristic is discussed below:

Throughput of a crusher is usually measured in mass per unit time, e.g. tons/hour, and is determined by such factors as: initial size of the material to be crushed, required size reduction, and the material's resistance to crushing. When one observes a rock crusher in action, what is seen is a great deal of churning about as the mass of particles attempt to work through the crusher. Small particles and large particles interfere with each other—resulting in a great deal of congestion. The net result is that the throughput is often considerably less than expected. The actual throughput is a complex function of the rock's hardness, shape (does it break into angular fragments, long "platy" fragments, or into rounded fragments?), and its size distribution (does much of the total mass consist of small particles, or large particles, or is the mass somewhat uniformly distributed over all sizes?). Size distribution is important because small particles cause "bridging" or "packing" effects which act to slow the flow of large particles through the crusher.

An output product of uniform size is almost always preferred. Even in those cases where a specific broad size distribution is required (e.g. for asphalt fillers), separate size fractions may be produced separately, and then combined. This is done because it is so difficult to adjust crushing machines to produce the desired size distribution.

In practice it is found that achieving a uniform product may require passage through more than one crusher—e.g. the output of a coarse crusher serves as the input to a finer crusher. Hence one desired characteristic of a crusher is that it be able to produce a uniform size of output by itself, with no additional equipment being required.

It is also found that the crushing operation may produce an excessive amount of undesired "fines", for example material able to pass through a 100 mesh screen. Fines often have to be classified as waste, and thus discarded. Excessive production of fines can thus increase the cost of the output product.

A large amount of size reduction on a single pass is also desirable. I.e. large input particles should be reduced to small particles in a single pass.

These desired characteristics serve to minimize the amount of equipment required to perform the overall crushing operation, and thus to minimize equipment and processing costs.

In practice, a crusher will often be specified based on previous engineering experience on similar jobs, and the crusher is found to be incorrectly sized when installed. Frequently, it will be found to have inadequate capacity. More rarely it will have excess capacity. An inadequate crusher can become a bottleneck, causing an entire processing plant or mill to become uneconomic, and even causing a project to fail.

The cure for an inadequate crusher usually involves installation of a second crusher in parallel with the first. This in turn leads to delays, additional expense, and re-engineering of the process, all of which contribute to avoidable economic costs.

The industry has a long felt need for a crusher having high throughput, uniform output, and substantial size reduction on a single pass. It should do this without significant increases in size, cost, or power required.

SUMMARY OF THE INVENTION

The present invention provides a method of injecting a fluid into the crushing region of a crusher, thereby increasing the performance of the crusher, in several ways. The injection of a fluid into the crushing region of the crusher will improve throughput, uniformity, and will result in a narrower size distribution of the crushed product.

One major application of the invention is to increase the capacity of an undersized crusher. Alternatively, it will permit installation of a smaller, less expensive, and more economical crusher than would be usable without the invention.

The injection of fluid may be done using separate nozzles fed by a manifold, with the manifold being remotely located from the nozzles, and tubing sections used to convey fluid from the manifold to the nozzles. Alternatively, the injection of fluid may be done using nozzles fed by a manifold which is located in proximity to the crushing region, so that the feed lines to the nozzles are short, thereby reducing the resistance to fluid flow. In another alternative, especially applicable to rotary crushers, the manifold is generally toroidal in shape, and located in proximity to the crushing region so that the nozzle feed lines are very short.

In a further refinement of the design using a rotary manifold, a slot is cut along the portion of the toroidal manifold closest to the crushing region. This slot serves as a continuous nozzle. The continuous nozzle may comprise a simple slot, or it may comprise a raised portion which forms the continuous nozzle. In this alternative, there are thus no feed lines at all.

The fluid may be added in a continuous flow into the crushing region, or it may be added in the form of a pulsatile flow. If added in a continuous flow, fluid may be added through one or more conventional nozzles having a generally circular cross-section, as described in the preferred embodiment; or fluid may be added through apertures having other shapes, such as for example, through the previously described continuous nozzle integral to a generally toroidal manifold.

If added as a pulsatile flow, the pulsatile flow may vary simultaneously at all nozzles, i.e. the entire fluid flow is pulsed on and off rhythmically. Alternatively, the pulsatile flow may be spatially modulated—as, for example, by diverting an essentially continuous flow first to one of several nozzles, then to the next nozzle, and then to the next. Another way to achieve spatial modulation would involve moving one or more nozzles, each having a continuous flow, in a pattern. An oscillating member internal to the toroidal manifold can be used to provide spatial modulation of the airflow from a continuous nozzle. The key feature of pulsatile flow, however it is mechanized, is that an individual particle in the crusher area would be subject to alternating, rather than continuous, fluid flow.

While there is no comprehensive theory as to why the injection of air, or another fluid, into the crushing area of a mechanical crusher results in improved performance, it is believed that most of the improvement is due to the reduction of bridging (also called arching, or packing) of the smaller material within the crushing area. Bridging occurs whenever small particles stick together or mechanically interlock with one another. A similar phenomenom prevents collapse of a tunnel dug in earth—the particles form an arch (the tunnel roof) by interlocking with one another.

High velocity air is more effective in moving small particles than large particles—thus high velocity air flow should be effective in reducing small particle bridging. The small particle bridging constitutes an impediment to the flow of larger material through the crusher.

While it is believed that such reduction of bridging is a major reason for the improved performance of crushers using the present invention, the validity of the present invention is not dependent upon this theory, or any other theory, as to why it works.

An appreciation of other aims and objects of the present invention, and a more complete and comprehensive understanding of the invention, may be achieved by studying the following description of a preferred embodiment, the description of two alternative preferred embodiments, and by referring to the accompanying drawings.

BRIEF DESCRIPTION OF THE DRAWINGS

It can be seen that the size of the opening between the mantle and the liner decreases progressively as material passes downward through the opening.

FIG. 2 also indicates oscillatory driving means which are used to rotate the mantle eccentrically relative to the liner.

FIG. 7 is a cross-sectional schematic view of a jaw crusher comprising a stationary lower jaw and a movable upper jaw. Rock particles to be crushed enter from the top and are crushed as they progress downwards. The fluid supply apparatus provides a flow of fluid between the jaws to facilitate the crushing operation.

FIG. 8 is a cross-sectional schematic view of a roller crusher in which two crushing roller rotate in proximity to one another. The fluid supply apparatus provides a flow of fluid between the rollers to facilitate the crushing operation.

DESCRIPTION OF THE PREFERRED EMBODIMENT

Figure 1:
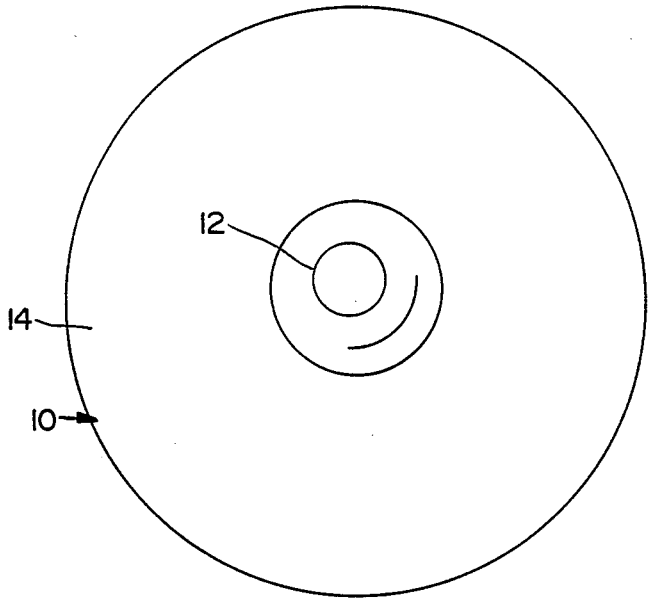
FIG. 1 is a plan view of a typical cone crusher.
Figure 2:
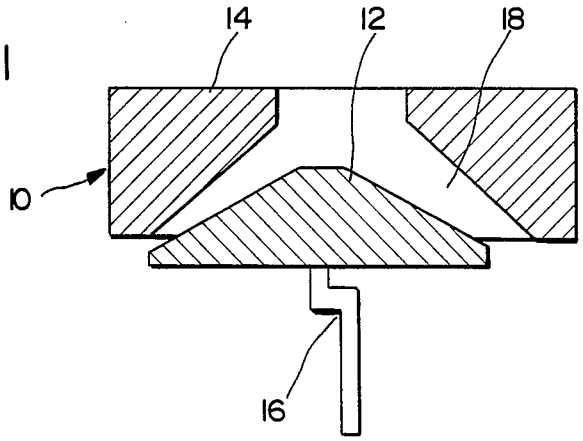
FIG. 2 is a cross-sectional view of a typical cone crusher The crushing space between the mantle and the liner is oriented a substantial angle to the vertical, so that material which is being crushed flows both downward and toward the outer periphery of the crusher.
Figure 3:
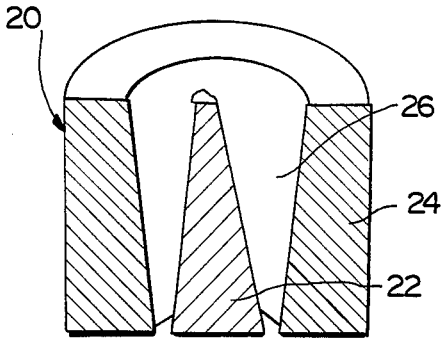
FIG. 3 illustrates the basic cross-section of a gyratory crusher having an inner crushing member, or mantle, and an outer crushing member, or liner. It can be seen that the difference between the cone crusher and gyratory crusher is in the orientation of the crushing space between the mantle and the liner.

FIGS. 1 and 2 indicate the construction of a typical cone crusher to which the preferred embodiment of the invention is to be applied. While the preferred embodiments is described in conjunction with a cone crusher, the invention is equally applicable to a gyratory crusher, and FIG. 3 shows the internal construction of a gyratory crusher, thereby clarifying the difference between a cone crusher and a gyratory crusher.

FIG. 1 is a plan view of a typical cone crusher 10, showing how the inner crushing member, or mantle, 12 is visible through the entrance aperture in the outer crushing member, or liner 14. FIG. 2 is a cross-sectional view of a typical cone crusher 10, showing mantle 12 and liner 14, and illustrating how the size of the opening 16 between the mantle 12 and the liner 14 decreases progressively as material passes downward from the entrance aperture at the top to the exit opening at the bottom. FIG. 2 also shows oscillatory driving means 16 which are used to rotate the mantle eccentrically relative to the liner.

The crushing space or opening 18 between the mantle 12 and the liner 14 is more horizontal than vertical, so that material which is being crushed flows both downward and out toward the outer periphery of the cone crusher 10. FIG. 3 is a cross-sectional view of a typical gyratory crusher 20, showing the mantle 22 and the liner 24. It can be seen that the crushing space 26 is oriented more vertically than the crushing space 18 of the cone crusher 10 of FIG. 2.

Figure 4:
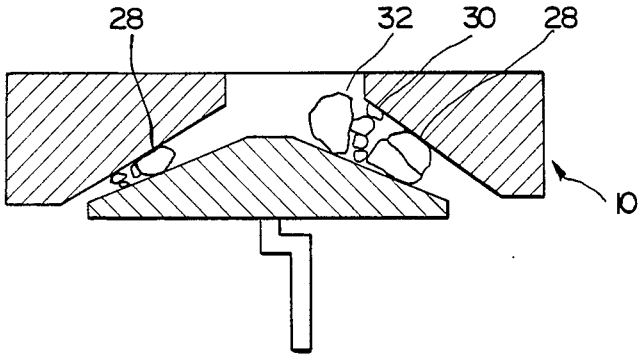
FIG. 4 shows particles being crushed between the mantle and liner of a cone crusher.

FIG. 4 is a cross-section through a cone crusher 10 which is crushing particles 28. Particles 28 are in the process of being crushed between the mantle and liner. As the particles 28 are reduced in size they move toward the exit opening. This process continues until the particles 28 are small enough to pass through the exit opening, and fall out of the crusher.

Figure 5:
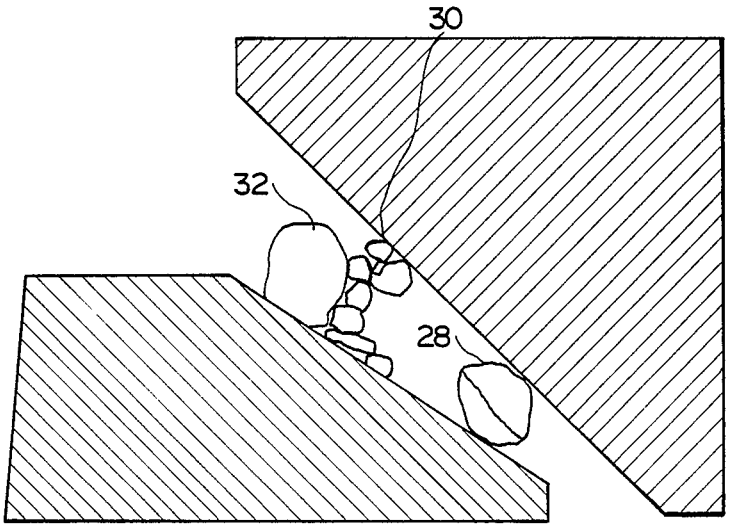
FIG. 5 is an enlarged view of the right hand portion of FIG. 4 showing the crushing of particles in more detail, and also showing how the bridging of particles can interfere with the flow of material through the crushing aperture.

A group of small particles 30 form a bridge between the liner and mantle, thereby preventing particle 32 from moving to a position where it can be crushed. FIG. 5 is an enlarged view of the right hand portion of FIG. 4 showing the packing of particles 30 in more detail, and showing how the packing of these particles prevents particle 32 from moving along the opening.

Figure 6:
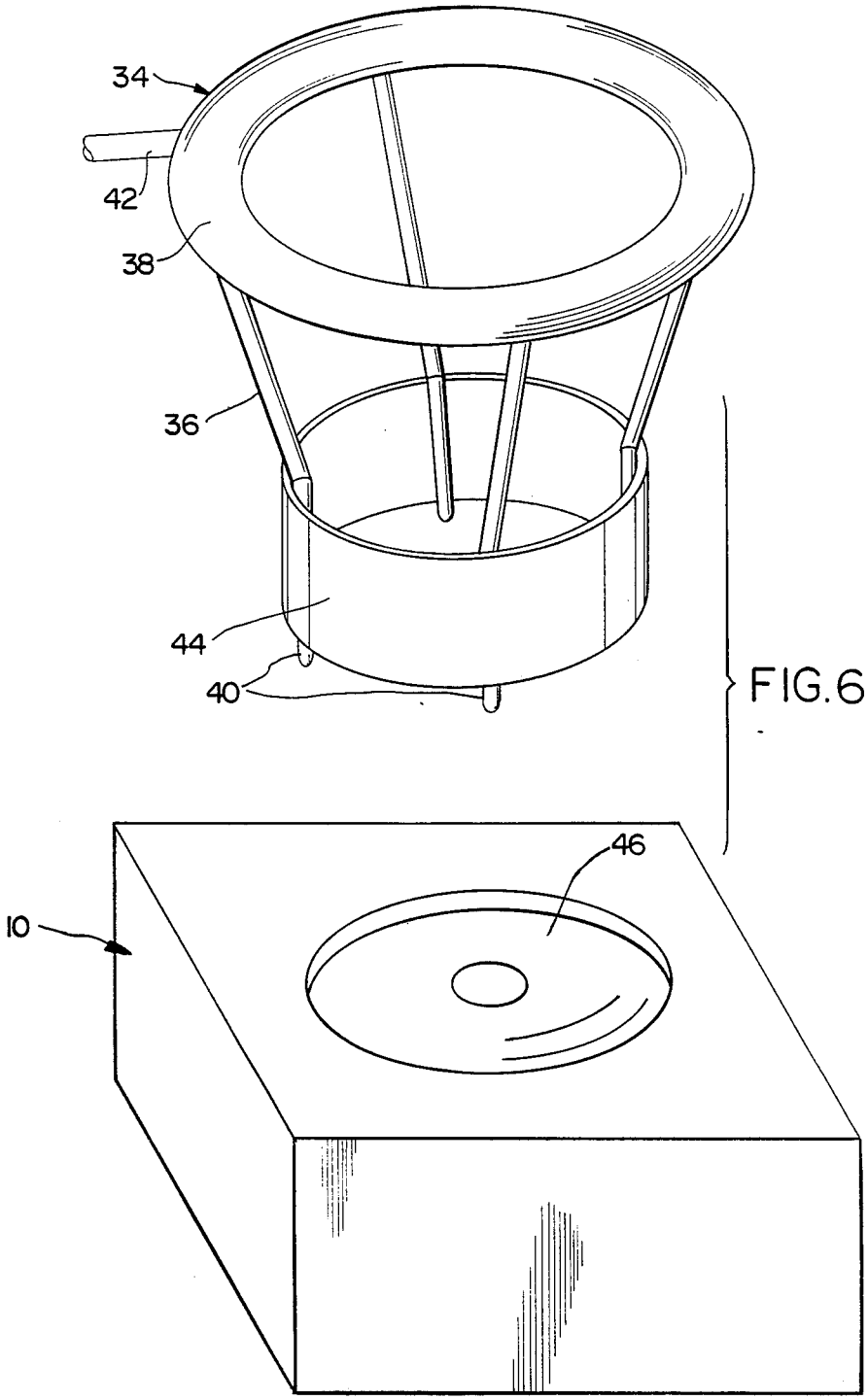
FIG. 6 is a perspective view of the preferred embodiment of the present invention as it would be installed in a cone crusher.

The preferred embodiment of the invention uses an air feed which is located in proximity to the crushing chamber of a rotary (gyratory or cone) crusher. FIG. 6 is a perspective view of the preferred embodiment of the present invention installed in a cone crusher 10. The invention 34 consists of a number of air tubes 36 connected to manifold 38 at one end, with each air tube 36 forming a nozzle 40 at the other end. Air is provided from manifold 38, which is fed air from air feed line 42. The nozzles 40 are supported by a generally circular flange 44 which is fitted closely into entrance aperture 46 of cone crusher 10. A conventional air supply means, which is not shown, is connected to the air feed line 42, and air passes via the manifold 38 and tubes 36 out through nozzles 40. A stream of air is thus injected into the crushing chamber 18 of the cone crusher 10.

The air flow may be modulated, or controlled, by conventional valving or modulation means, so that the flow from any or all nozzles is pulsatile, rather than continuous. The pulsatile flow may be arranged so that all nozzles pulse on and off simultaneously, or it may be arranged so that one or more has a high flow rate while the others have a low flow rate, with the high flow rate being cyclically transferred among nozzles.

TEST RESULTS
Experiments have been performed using the preferred embodiment described above, with steady (non-pulsatile) flow, with the following results:

| Rock Type | Air pressure | Crushing Rate (lb/sec) | % increase in rate |
|---|---|---|---|
| Quartzite | 0 (no air flow) | 0.21 | 0 |
| Quartzite | 4 | 0.30 | 43% |
| Quartzite | 6 | 0.31 | 48 |
| Quartzite | 8 | 0.33 | 55 |
| Quartzite | 10 | 0.34 | 60 |
| Quartzite | 13 | 0.36 | 70 |
| Limestone | 0 | 0.10 | 0 |
| Limestone | 2 | 0.14 | 39 |
| Limestone | 3 | 0.15 | 51 |
| Limestone | 6 | 0.17 | 68 |
| Limestone | 10 | 0.19 | 86 |

DESCRIPTION OF TWO ALTERNATIVE EMBODIMENTS

The first alternative embodiment of the invention is its use on a jaw crusher, as shown in FIG. 7. One or more ports 48 are connected to a manifold 50, and positioned so that ports 48 inject fluid 52 into the crushing chamber between the stationary jaw 54 and the crushing jaw 56. The moving jaw rotates about pivot 58 under the force applied by force applying means 60. Fluid 52 is injected in the direction of the flow of solid material to be crushed, which is from left to right in this Figure.

The second alternative embodiment of the invention is its use on a roll crusher, as shown in FIG. 8. One or more ports 48 are arranged so as to inject fluid 52 into the general area between the rollers 62. The fluid is injected in the direction of the flow of solid material to be crushed.

The air feed in FIGS. 7 and 8 consists of one or more nozzlelike feed ports, each of which blows air into a section of the crushing chamber in the general direction of material flow. Alternatively the air feed may consist of an essentially continuous aperture. Air is supplied to the nozzles, or to the continuous aperture, so that there is a flow of air within the crushing chamber, in the same general direction as the motion of the material to be crushed.

When using separate nozzles, the air flow to each nozzle may be modulated, so that it fluctuates continuously in a controlled, pulsatile manner. The modulation may be such that all nozzles'air flow are in phase with one another, or the modulation may be such that different nozzles have different flows at the same time, i.e. the flow to a particular nozzle is out of phase with that to one or more other nozzles.

Although specific embodiments of the invention are shown and described, other variations may be made and it is intended that the Although specific embodiments of the invention are shown and described, other variations may be made and it is intended that the foregoing disclosure be considered only illustrative of the principles of the invention, and not construed in a limiting sense. The invention is applicable to other types of crushers than the gyratory, cone, roller, and jaw crushers described here; other fluids than air may be used; multiple fluids may be used; and the flow of fluid may be pulsatile, rather than steady.

What is claimed is:

1. An apparatus comprising:
   a. at least one fluid supply means associated with a rotary crusher, with a crushing region located between an eccentrically rotated mantle and a stationary liner; and
   b. at least one injecting apparatus for injecting air into a crushing region of said crushing apparatus, said injecting apparatus including:
      (1) a port for injecting said air, said port being generally oriented in a direction of a material flow through said crushing region of said crushing apparatus; and
      (2) an air manifold located adjacent to said crushing area;
         (a) said air manifold being generally toroidal and located adjacent to said crushing chamber, and having a slotted opening along a region generally closest to said crushing chamber; and
         (b) a single continuous air nozzle using said slotted opening, so that said manifold and said nozzle form an integrated nozzle unit having an outlet in said chamber, said integrated nozzle unit being oriented to provide an air flow generally coincident with said direction of said material flow through said chamber.

2. An apparatus comprising:
   a. at least one fluid supply means associated with a rotary crusher, with a crushing region located between an eccentrically rotated mantle and a stationary liner; and
   b. at least one injecting apparatus for injecting air into a crushing region of said crushing apparatus, said injecting apparatus including:
      (1) a port for injecting said air, said port being generally oriented in a direction of a material flow through said crushing region of said crushing apparatus; and
      (2) an air manifold located adjacent to said crushing area;
         (a) said air manifold being generally toroidal and located adjacent to said crushing chamber, and having a slotted opening along a region generally closest to said crushing chamber; and
         (b) a single continuous air nozzle using said slotted opening, so that said manifold and said nozzle form an integrated nozzle unit having an outlet in said chamber, said integrated nozzle unit being oriented to provide an air flow generally coincident with said direction of said material flow through said chamber.
   c. air modulation means which cause said integrated nozzle unit to emit air whose velocity varies with time.

* * * * *